US005463783A

United States Patent [19]

Pope

[11] Patent Number: 5,463,783

[45] Date of Patent: Nov. 7, 1995

[54] COMBINATION BLANKET/CARRYING BAG/APPAREL

[76] Inventor: Brenda Pope, 8 E. 18th St., New York, N.Y. 10003

[21] Appl. No.: 154,310

[22] Filed: Nov. 18, 1993

[51] Int. Cl.[6] ..... A47G 9/06

[52] U.S. Cl. ..... 5/417; 5/419; 2/88

[58] Field of Search ..... 5/417–420, 485; 2/69, 69.5, 88, 89, 94

[56] References Cited

U.S. PATENT DOCUMENTS

| | | | |
|---|---|---|---|
| 1,215,139 | 2/1917 | Gail | 2/89 |
| 2,462,780 | 2/1949 | Schiller | 5/485 |
| 2,745,105 | 5/1956 | Schaefer | 2/89 |
| 2,898,609 | 8/1959 | Storie | 5/419 |
| 3,176,315 | 4/1965 | Freund | 5/417 |
| 3,958,274 | 5/1976 | Klauber | 5/420 |
| 4,370,755 | 2/1983 | Crumby | 2/88 |
| 4,375,111 | 3/1983 | Hall | 5/419 |
| 4,951,333 | 8/1990 | Kaiser | 5/417 |

FOREIGN PATENT DOCUMENTS

| | | | |
|---|---|---|---|
| 77288 | 9/1949 | Norway | 5/419 |
| 688307 | 3/1953 | United Kingdom | 5/417 |

*Primary Examiner*—Flemming Saether

*Attorney, Agent, or Firm*—Malin, Haley, DiMaggio & Crosby

[57] ABSTRACT

A combination blanket/carrying bag/apparel includes a generally rectangular sheet of fabric having a substantially central slit-like opening therein; a tubular piece of flexible material having opposite open ends, with one end being secured to the sheet of fabric around the central opening thereof; a flexible carrying bag secured to the sheet of fabric adjacent a periphery thereof, the carrying bag having an opening through which the fabric can be inserted for carrying; and at least one pillow holder secured to the sheet of fabric adjacent the periphery thereof, so as to overlie the sheet of fabric.

17 Claims, 3 Drawing Sheets

COMBINATION BLANKET/CARRYING BAG/APPAREL

BACKGROUND OF THE INVENTION

The present invention relates generally to an accessory for beach or other use, and particularly, to a fabric item which can be converted for use as a blanket, a carrying bag and wearing apparel.

A common problem when travelling to the beach, on a boat or the like is that numerous bulky items must be carried. For example, it is generally necessary to bring a blanket and/or towel, a bag for carrying additional items, and clothing in the event that the weather becomes cool. As a result, the carrying of such items, along with other conventional items such as a cooler or the like, becomes burdensome.

OBJECTS AND SUMMARY OF THE INVENTION

Accordingly, it is an object of the present invention to provide a combination blanket/carrying bag/apparel that overcomes the problems of the aforementioned prior art.

It is another object of the present invention to provide a combination blanket/carrying bag/apparel that can be converted for use to a blanket, a carrying bag and wearing apparel.

It is still another object of the present invention to provide a combination blanket/carrying bag/apparel having pillow supports when used as a blanket.

In accordance with an aspect of the present invention, a combination blanket/carrying bag/apparel includes a sheet of fabric having a substantially central opening therein; and a flexible carrying bag secured to the sheet of fabric adjacent a periphery thereof, the carrying bag having an opening through which the fabric can be inserted for carrying.

Preferably, the sheet of fabric has a generally rectangular configuration and is made from a material selected from the group consisting of cotton, a cotton blend and terry cloth.

In addition, it is preferable that the flexible carrying bag is made from a fabric material and is secured to a corner of the generally rectangular sheet of fabric. The carrying bag is preferably made from a material selected from the group consisting of nylon, dacron and polyester in combination with, for example, cotton.

The central opening is a generally slit-like opening.

In accordance with another aspect of the present invention, a combination blanket/carrying bag/apparel includes a sheet of fabric having a substantially central opening therein; a tubular piece of flexible material having opposite open ends, with one end being secured to the sheet of fabric around the central opening thereof; and a flexible carrying bag secured to the sheet of fabric adjacent a periphery thereof, the carrying bag having an opening through which the fabric can be inserted for carrying.

The tubular piece is preferably made from a material selected from the group consisting of cotton, a cotton blend and terry cloth.

In accordance with still another aspect of the present invention, a combination blanket/carrying bag/apparel includes a sheet of fabric having a substantially central opening therein; a tubular piece of flexible material having opposite open ends, with one end being secured to the sheet of fabric around the central opening thereof; a flexible carrying bag secured to the sheet of fabric adjacent a periphery thereof, the carrying bag having an opening through which the fabric can be inserted for carrying; and at least one pillow holder secured to the sheet of fabric adjacent the periphery thereof, so as to overlie the sheet of fabric.

Each pillow holder is formed by a piece of fabric secured to the sheet of fabric so as form a pillow enclosure, with the piece of fabric being unsecured to the sheet of fabric at a portion thereof to form an opening. Each pillow holder has closure means for closing the opening to retain a pillow in the enclosure. Preferably, there are two pillow holders formed at opposite corners of sheet of fabric.

The above and other objects, features and advantages of the invention will become readily apparent from the following detailed description thereof which is to be read in connection with the accompanying drawings.

DETAILED DESCRIPTION OF A PREFERRED EMBODIMENT

Figure 1:
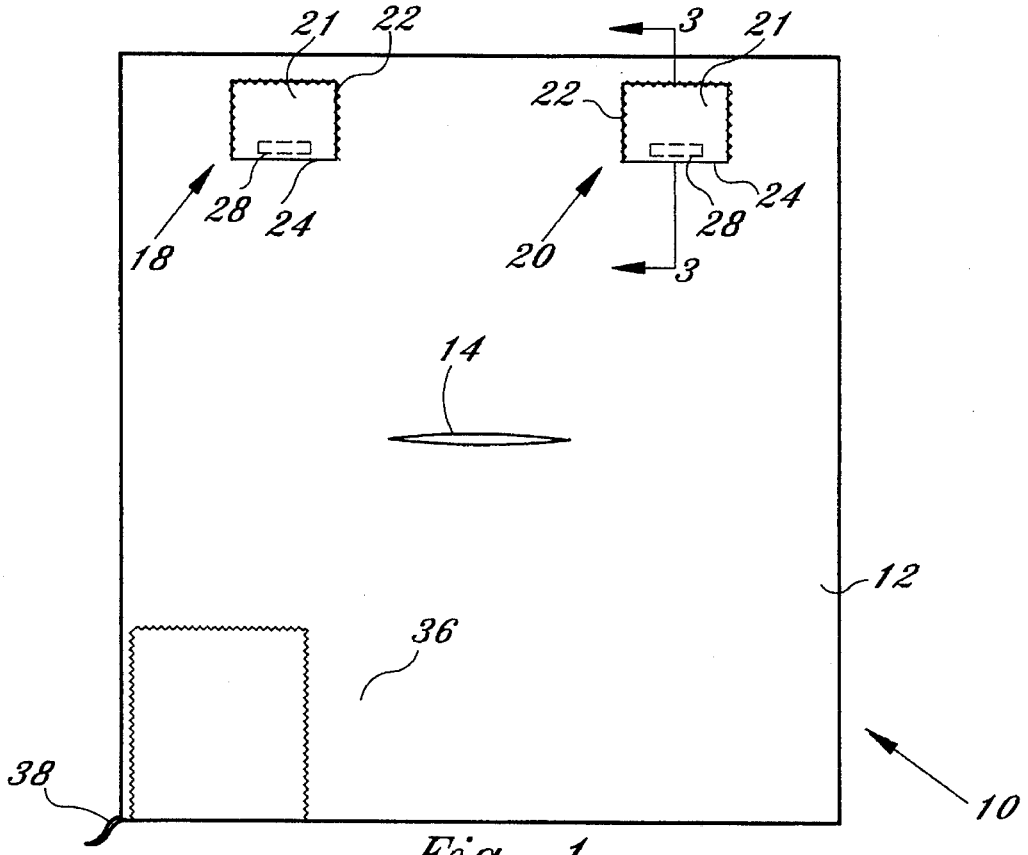
FIG. 1 is a top plan view of a combination blanket/carrying bag/apparel according to the present invention.
Figure 2:
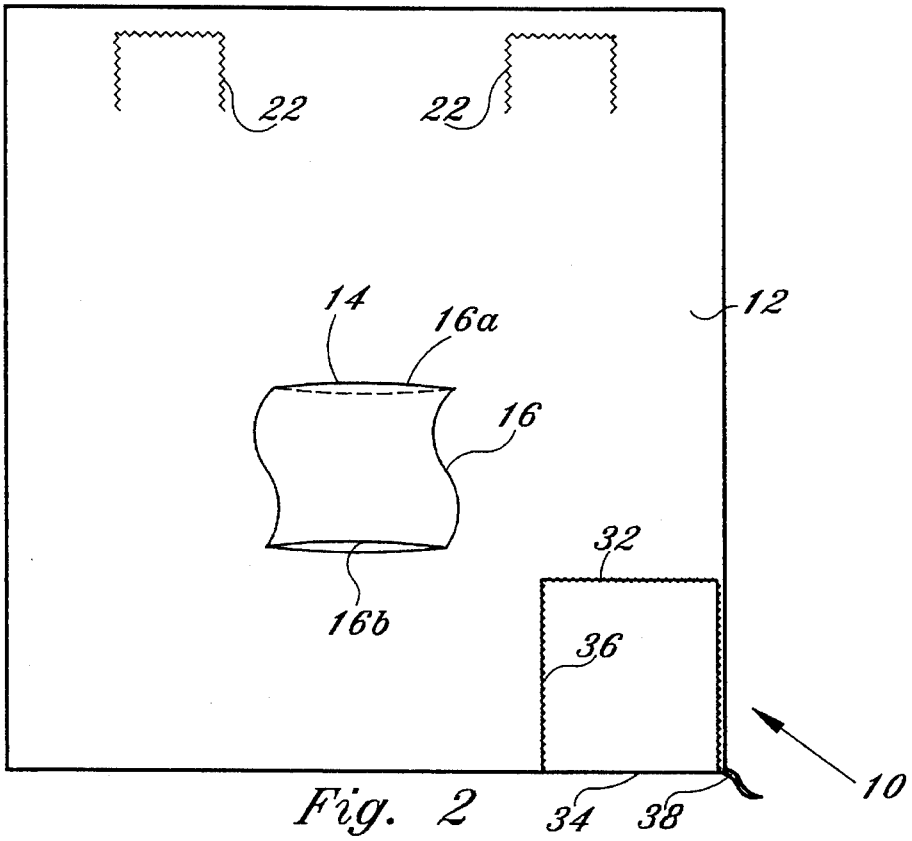
FIG. 2 is a bottom plan view of the combination blanket/carrying bag/apparel of FIG. 1.
Figure 3:
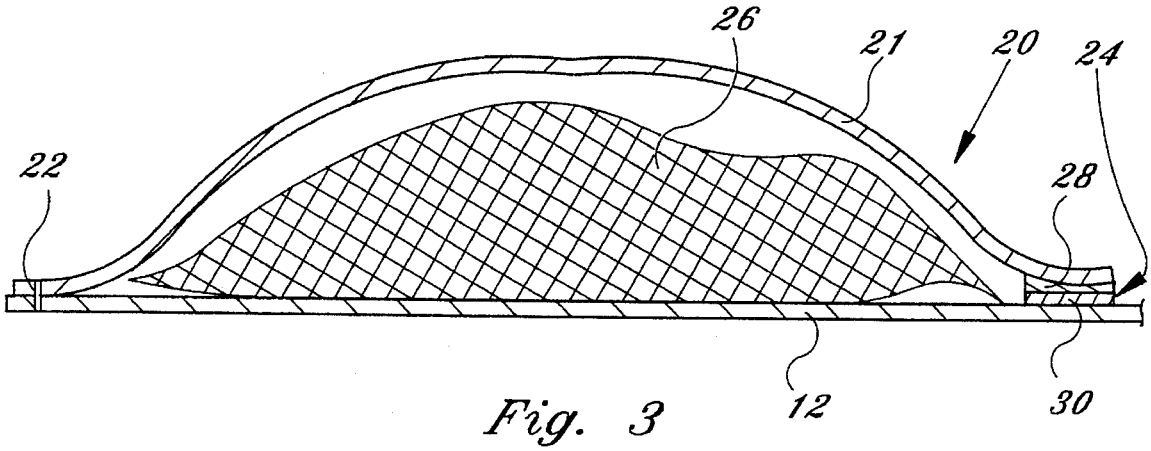
FIG. 3 is a cross-sectional view of the combination blanket/carrying bag/apparel of FIG. 1, taken along line 3—3 thereof.
Figure 5:
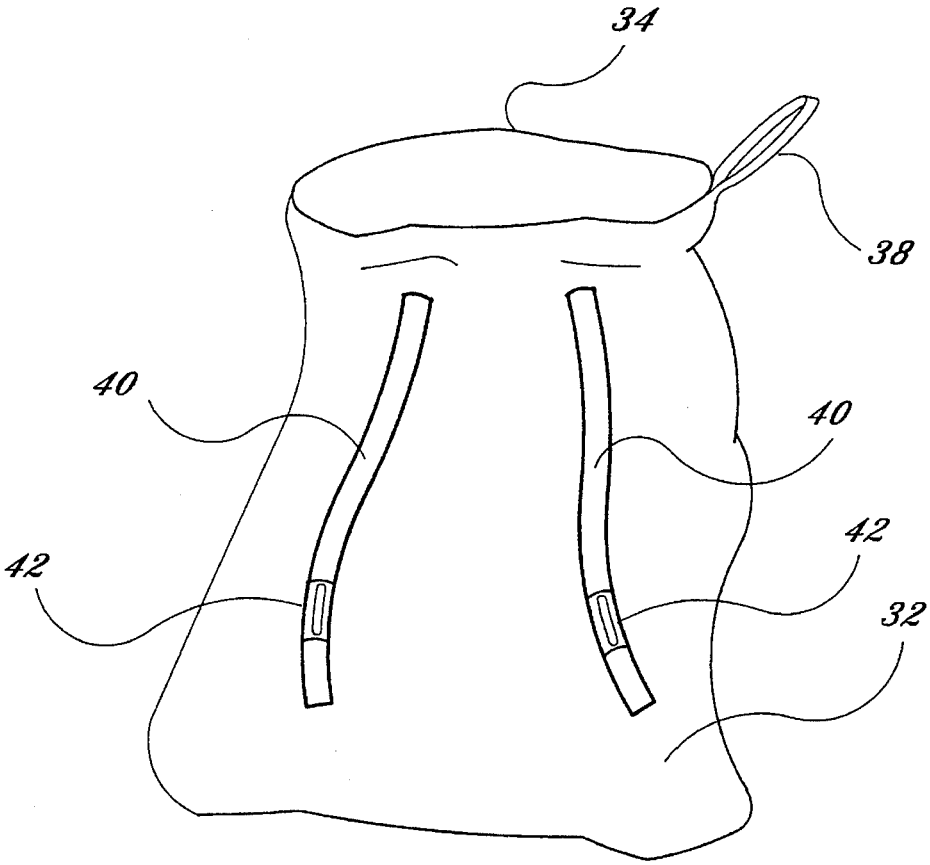
FIG. 5 is perspective view of the combination blanket/carrying bag/apparel converted into a carrying bag.
Figure 4:
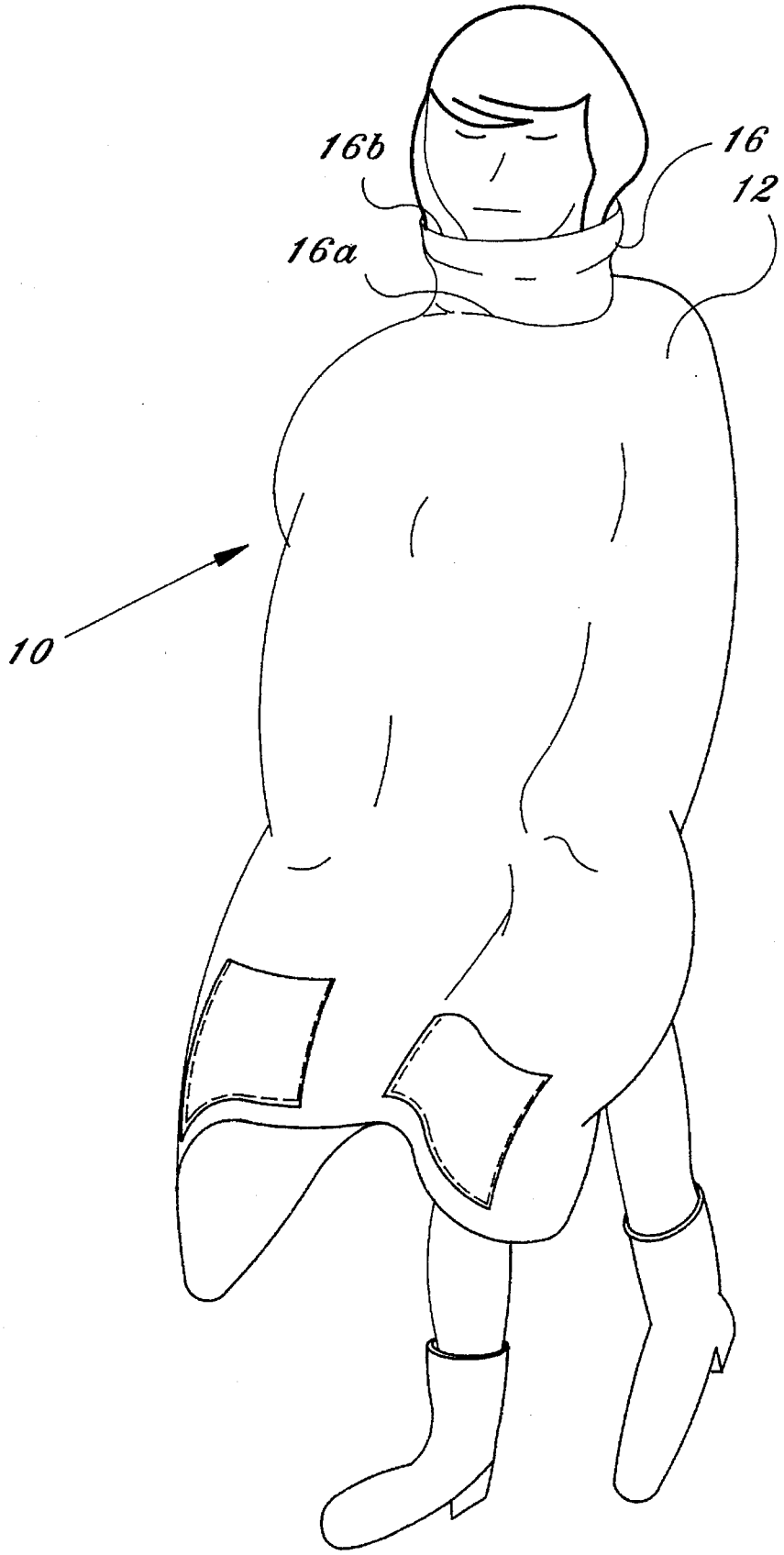
FIG. 4 is a perspective view of the combination blanket/carrying bag/apparel, showing the same being worn by a person.

Referring to the drawings in detail, a combination blanket/carrying bag/apparel 10 according to the present invention includes a sheet 12 of fabric, such as terry cloth, cotton, a cotton blend or the like. Sheet 12 can be any suitable shape, such as square, rectangular, circular or the like. Preferably, sheet 12 has a rectangular configuration with dimensions of approximately five feet by six feet. In this regard, the combination blanket/carrying bag/apparel 10 can be used as a blanket at the beach, across a lounge chair or the like.

A central slit-like opening 14 is provided in sheet 12 and has a length of approximately one foot. With this arrangement, sheet 12 can fit over the head of a person and be worn as a poncho. In order to protect the neck of the person from harsh winds and the like, for example, when riding on a boat, a generally tubular piece 16 of material is provided. Tubular piece 16 has opposite open ends **16*a* and 16*b*, with open end 16*a* being secured around the periphery of slit-like opening 14 by any suitable means, such as stitching. Tubular piece 16** can be made of any suitable material, such as nylon, dacron, polyester or the like, and preferably has a length of approximately sixteen inches.

In addition, two pillow holders 18 and 20 are secured at opposite corners of sheet 12. Specifically, each pillow holder 18 and 20 is made from a sheet 21 of material, such as nylon, dacron, polyester or the like, which is secured around three edges thereof to sheet 12 by any suitable means such as stitching 22. As a result, each pillow holder 18 and 20 forms an enclosure with sheet 12 and has one open end 24, which faces inwardly of sheet 12. In this regard, a pillow 26, such as an inflatable pillow, can be inserted within pillow holders 18 and 20, for propping up the head of two people lying on sheet 12.

In order to prevent the pillow 26 from escaping from pillow holders 18 and 20, the open end of each sheet 21 which forms pillow holders 18 and 20 has a closure 28 secured centrally thereon for engaging with a closure 30 formed in correspondence therewith on sheet 12. Preferably, closures 28 and 30 are in the form of small strips of material containing loops and hooks, respectively, which engage with each other, and which are commonly identified and sold under the trademark "VELCRO".

A bag 32 also made out of a material such as nylon, dacron, polyester or the like, is secured in an inverted or inside-out manner, to a corner of sheet 12, preferably on the opposite side from pillow holders 18 and 20. In this manner, when lying on sheet 12, bag 32 is positioned beneath sheet 12. Bag 32 has an open end 34 which is positioned to the outside of sheet 12, and is secured to sheet 12 around the remaining three sides thereof by any suitable means such as stitching 36. It is preferable that bag 32 has a conventional string closure 38 around the open side thereof.

Thus, it is only necessary to reinvert bag 32 and to stuff sheet 12 thereinto, and then tie bag 32 shut with string closure 38. Further, other items can then be placed into bag 32.

The outer face of bag 32, which is on the inside when bag 32 is inverted during the time that sheet 12 is used as a blanket, preferably has straps 40 secured thereto, by which a person can carry bag 32 as a back pack.

In addition, straps 40 can have conventional release couplings 42 at one end for adjusting the length of straps 40, and for securing items such as beach digging tools, buckets and the like thereto, for carrying.

It will therefore be appreciated that the present invention provides a combination blanket/carrying bag/apparel 10 that can be used as a blanket. Alternatively, combination blanket/carrying bag/apparel 10 can be converted to a carrying bag 32 for holding sheet 12 as well as other items. In the event of inclement weather, combination blanket/carrying bag/apparel 10 can be converted into a poncho having a neck protecting portion.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

What is claimed is:

1. A combination blanket/carrying bag/apparel comprising:

a continuous sheet of fabric having a substantially central opening therein, said sheet of fabric having a top surface and a bottom surface;

a tubular piece of flexible material having opposite open ends, with one said end being secured to the bottom surface of said sheet of fabric around said central opening thereof;

a flexible carrying bag secured to the bottom surface of said sheet of fabric adjacent a periphery thereof, said carrying bag having an opening through which said fabric can be inserted for carrying; and at least one pillow holder for receiving a removable pillow secured to the top surface of said sheet of fabric adjacent said periphery thereof, so as to overlie said sheet of fabric.

2. A combination blanket/carrying bag/apparel according to claim 1, wherein said pillow holder is formed by a piece of fabric secured to said sheet of fabric so as to form a pillow enclosure, with said piece of fabric being unsecured to said sheet of fabric at a portion thereof to form an opening.

3. A combination blanket/carrying bag/apparel according to claim 2, wherein said pillow holder has closure means for closing said opening to retain a pillow in said enclosure.

4. A combination blanket/carrying bag/apparel according to claim 1, wherein there are two said pillow holders formed at opposite corners of said sheet of fabric.

5. A combination blanket/carrying bag/apparel according to claim 1, wherein said tubular piece is made from a material selected from the group consisting of cotton, a cotton blend and terry cloth.

6. A combination blanket/carrying bag/apparel according to claim 1, wherein said sheet of fabric has a generally rectangular configuration.

7. A combination blanket/carrying bag/apparel according to claim 6, wherein said flexible carrying bag is made from a fabric material and is secured to a corner of said generally rectangular sheet of fabric.

8. A combination blanket/carrying bag/apparel according to claim 1, wherein said central opening is a generally slit-like opening.

9. A combination blanket/carrying bag/apparel according to claim 1, wherein said carrying bag is made from a material selected from the group consisting of nylon, dacron and polyester.

10. A combination blanket/carrying bag/apparel according to claim 1, wherein said sheet of fabric is made from a material selected from the group consisting of cotton, a cotton blend and terry cloth.

11. A combination blanket/carrying bag/apparel according to claim 1, wherein said flexible carrying bag secured to the bottom surface of said sheet of fabric in an inverted or inside-out manner.

12. A combination blanket/carrying bag/apparel according to claim 1, further including a conventional string enclosure around the opening of said flexible carrying bag.

13. A combination blanket/carrying bag/apparel according to claim 1, wherein an outer face portion of said flexible carrying bag having at least one strap secured thereto.

14. A combination blanket/carrying bag/apparel according to claim 13 where said strap having release means for securing items to said strap.

15. A combination blanket/carrying bag/apparel according to claim 13 where said strap having means for adjusting the length of said strap.

16. A combination blanket/carrying bag/apparel according to claim 1 wherein said sheet of fabric is sized for use as a two person blanket.

17. A combination blanket/carrying bag/apparel according to claim 1, wherein the carrying bag opening is disposed along an outer edge of said sheet of fabric.

* * * * *